United States Patent [19]

Marks

[11] 4,334,227

[45] Jun. 8, 1982

[54] ELECTRONIC MARKER DEVICE AND METHOD OF MAKING SAME

[75] Inventor: Barry M. Marks, Austin, Tex.

[73] Assignee: A.P.C. Industries, Inc., Austin, Tex.

[21] Appl. No.: 191,064

[22] Filed: Sep. 26, 1980

[51] Int. Cl.[3] ..... H01Q 1/40; H01Q 1/04

[52] U.S. Cl. ..... 343/719; 343/867; 343/873; 29/600

[58] Field of Search ..... 29/600; 343/719, 741, 343/867, 873

[56] References Cited

U.S. PATENT DOCUMENTS 2,863,147 12/1958 Berlin ..... 343/873

3,216,016 11/1965 Tanner ..... 343/741

4,187,509 2/1980 Weiner ..... 343/873

*Primary Examiner*—Eli Lieberman

*Attorney, Agent, or Firm*—Wm. T. Wofford; James C. Fails; Arthur F. Zobal

[57] ABSTRACT

Passive type electronic marker device is hoop shaped, with the hoop thickness in the radial direction being substantially less than the hoop width in the axial direction and with a tuned circuit disposed within the hoop. Improved structure and the method involves a mandrel portion on which the tuned circuit coil is wound, a mating cover band, and special peripheral hermetic seals.

12 Claims, 12 Drawing Figures

Fig. 9
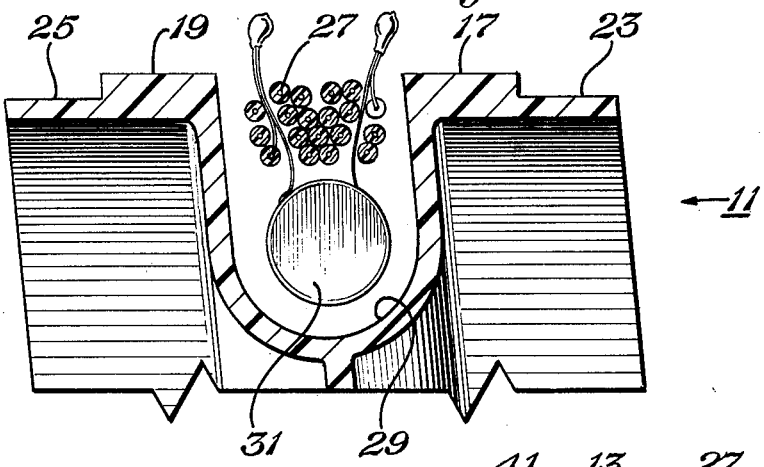
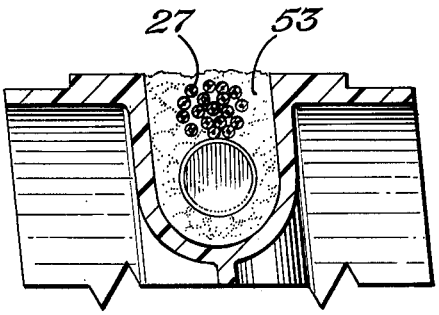
Fig. 10
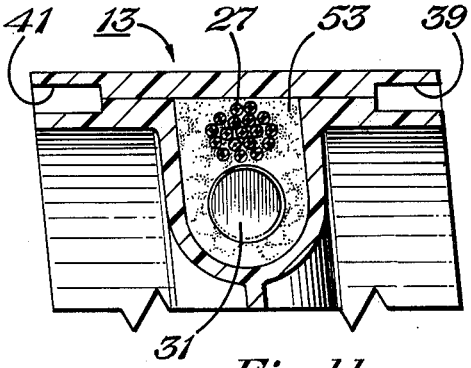
Fig. 11
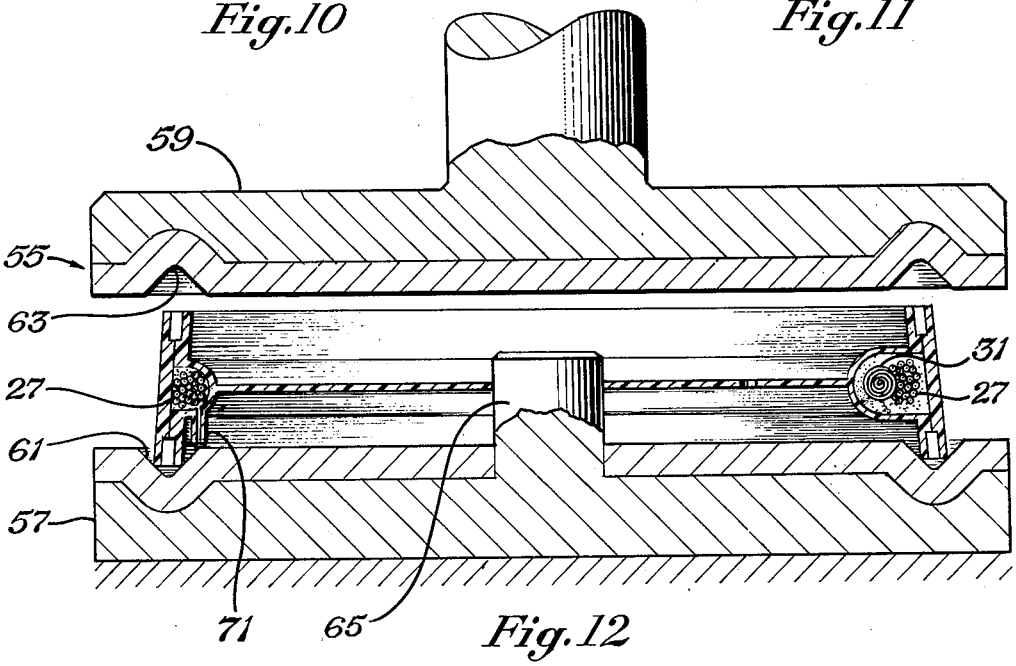
Fig. 12

ELECTRONIC MARKER DEVICE AND METHOD OF MAKING SAME

FIELD OF INVENTION

The invention relates to electronic marker devices of the tuned circuit passive type that are normally buried adjacent to buried utility components which from time to time may need to be located.

DESCRIPTION OF THE PRIOR ART

The relevant electronic marker devices of the prior art of which I am aware comprise a tuned circuit sealed within a plastic envelope. The tuned circuit is made up of a circularly wound coil of wire connected in parallel with a capacitor, with the assembly having a generally torroidal configuration. The coil is banded or tied at several peripheral locations. The plastic envelope has a generally "U"-shaped periphery with the side at the top of the "U" being initially open, and being sealed after the tuned circuit assembly has been inserted. The coil assembly may typically have a diameter of approximately twelve inches, with the "U" portion of the envelope interior being sized to receive the coil assembly peripheral shape with minimal distortion.

The electronic marker devices of the prior art above described are subject to a number of disadvantages. They do not provide good dimensional stability for the tuned circuit coil, since forces applied in directions perpendicular to the envelope side surfaces can easily cause movement of those surfaces, and consequently the coil, away from the central plane of the envelope, and the resulting coil distortion will adversely affect the performance of the tuned circuit. Also, relative movement of the inner side surfaces of the envelope, which can occur due to movement away from the central plane and/or compressional forces, causes distortion so that the coil cross section becomes less-circular and expands, thus disturbing the field coupling relationship of the turns, with resulting adverse affects on the tuned circuit performance. Further, since the coil inner periphery is not well supported, impact forces applied on the periphery of the envelope can cause partial collapse of the coil, again with adverse affects on the tuned circuit performance.

The objectives of the present invention are to provide improved electronic marker devices that are not subject to the disadvantages of those of the prior art and to provide improved methods of manufacture for electronic marker devices.

BRIEF DESCRIPTION OF DRAWINGS

FIG. 9 is a fragmentary section view of the mandrel portion at the capacitor location, showing the capacitor and coil in place.

FIG. 10 is like FIG. 9 but with filling compound added.

FIG. 11 is like FIG. 10 but with the cover band in place.

FIG. 12 is a schematic view of a sealing die press, partly cut away, with the die press in the open position and an assembled electronic marker device in place and ready to be sealed.

SUMMARY OF THE INVENTION

The invention provides an improved electronic marker device of the passive tuned circuit type and method of making same. The electronic marker device of the invention has three primary components which are a mandrel portion, a cover band portion and a tuned circuit assembly. The mandrel portion and the cover band portion are hoop shaped, with a cover band interior surface matingly engaging mandrel exterior surfaces and with the outer edge portions forming peripheral hermetic seals. A tuned circuit assembly is disposed within the mandrel portion. In a perferred embodiment, the mandrel portion is provided a central peripheral groove and capacitor receiving cavity; the tuned circuit capacitor is disposed in the cavity and the tuned circuit coil is wound on the mandrel; the peripheral seals are formed by utilizing "V"-shaped dies in a die press to apply heat and pressure to the outer edge portions of the mandrel portion and cover band assembly, which outer edge portions have undercuts so that there is a space between them; the mandrel portion is provided a central web having a plurality of side openings and a center opening.

An electronic marker device constructed in accordance with the principles of the invention is highly resistant to physical distortion. The coil is closely confined within a housing so that there is no distortion of the coil turns. The resulting excellent dimensional stability assures consistently high performance for the tuned circuit. Also, because of the high performance of the tuned circuit, it is possible to make the physical dimensions of the electronic marker device smaller, with resulting economies.

DESCRIPTION OF PREFERRED EMBODIMENT

Figure 1:
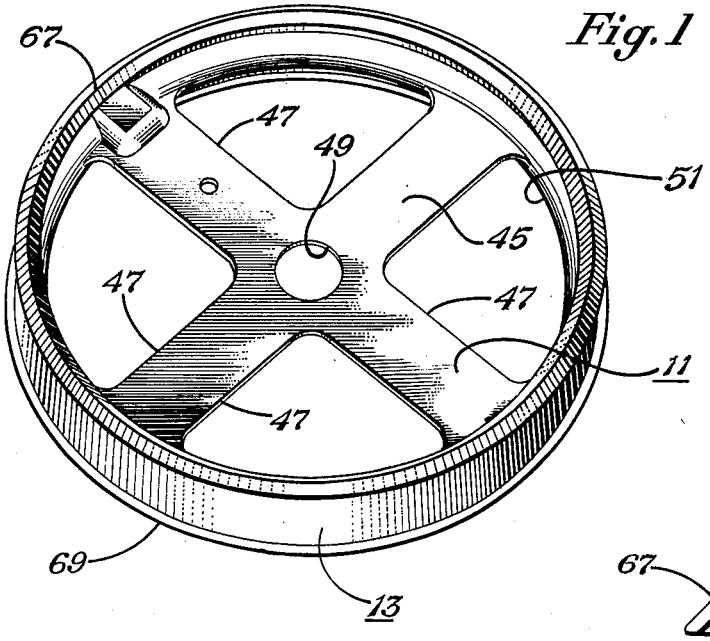
FIG. 1 is a schematic perspective view showing an electronic marker device in accordance with a perferred embodiment of the invention.
Figure 2:
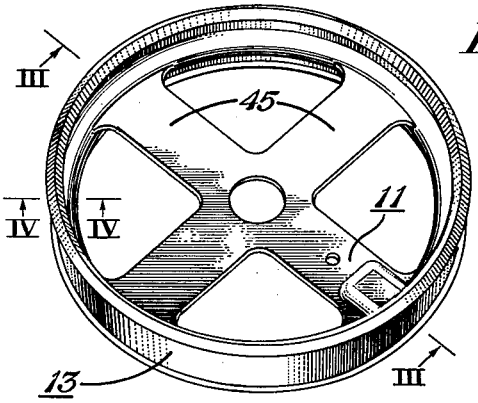
FIG. 2 is a schematic perspective view showing the opposite side of the device of FIG. 1.
Figure 4:
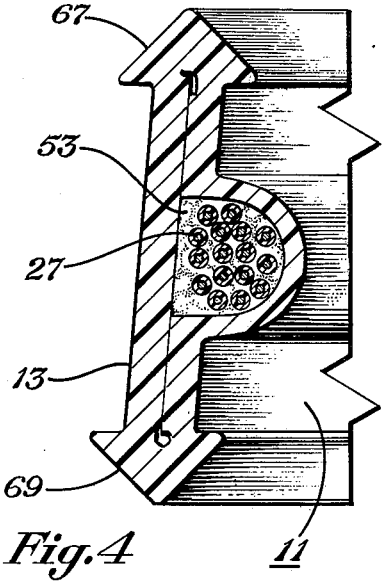
FIG. 4 is an enlarged partial section view taken at lines IV—IV of FIG. 2.
Figure 3:
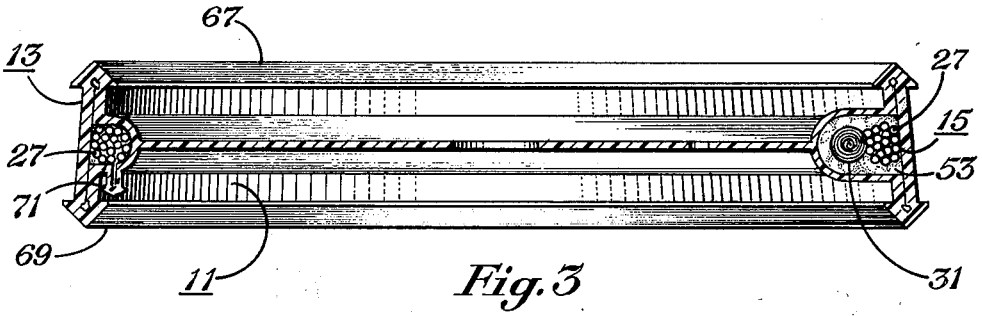
FIG. 3 is a section view taken at lines III—III of FIG. 2.
Figure 5:
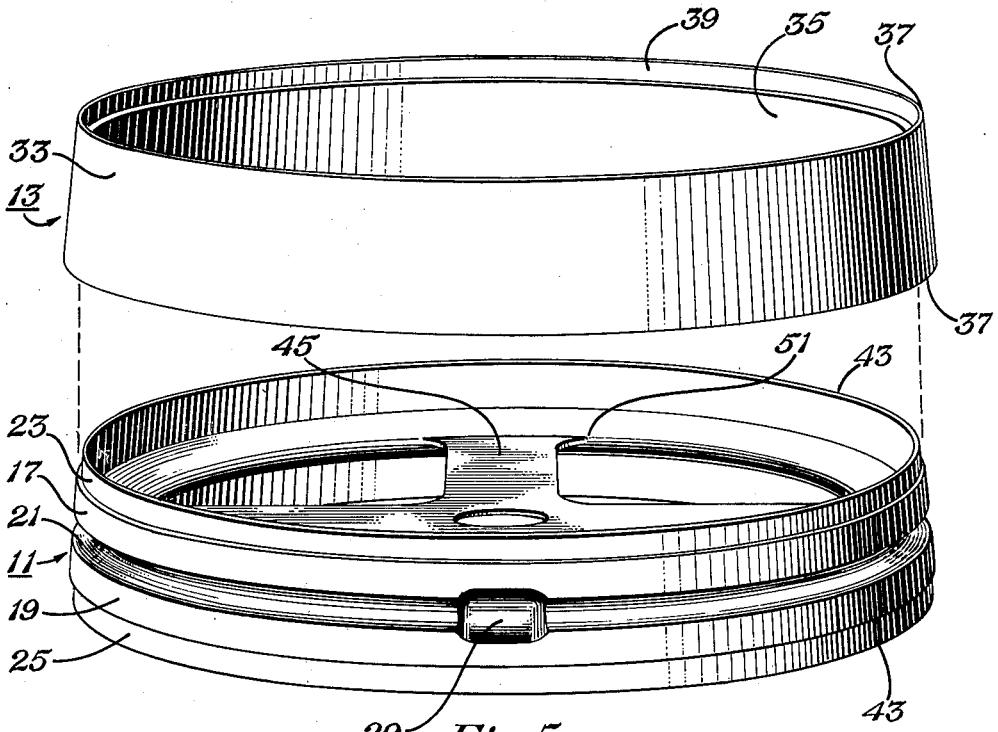
FIG. 5 is an exploded perspective view showing the electronic marker device mandrel portion and cover band.
Figure 6:
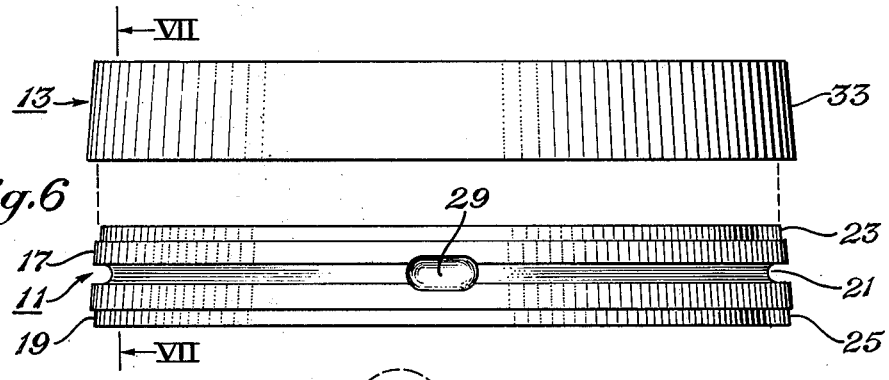
FIG. 6 is an exploded front elevational view showing the electronic marker device mandrel portion and cover band.
Figure 7:
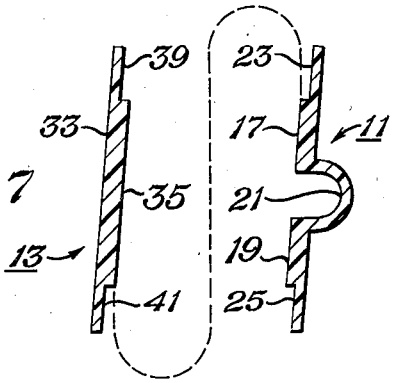
FIG. 7 is an exploded section view taken at lines VII—VII of FIG. 6.
Figure 8:
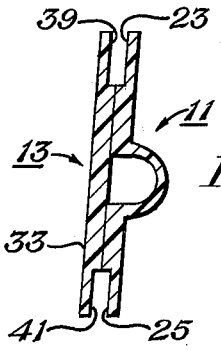
FIG. 8 is a section view of the parts of FIG. 7 in their assembled relation.

Referring now to the drawings, FIGS. 1–4 are various views of the completed electronic marker device in accordance with a preferred embodiment of the invention; FIGS. 5–8 are various views of certain parts of the electronic marker device prior to its completion; and FIGS. 9–12 are various views showing several stages in the manufacture of the electronic marker device.

The electronic marker device may be regarded as having three primary components, which are a mandrel portion 11, a cover band 13 and a tuned circuit assembly 15.

The mandrel portion 11 is a generally hoop shaped molded part made of thermoplastic material, with the thickness of the hoop in the radial direction being substantially less than the width of the hoop in the axial direction. The mandrel portion 11 has outer peripheral surfaces 17, 19 whose inner margins border opposite sides of a peripheral groove 21, and whose outer margins border respective undercut surfaces 23, 25. The peripheral groove 21 is generally "U"-shaped and has a bottom radius that exceeds the desired radius of the cross section of the coil 27 of the tuned circuit assembly 15. The depth of the peripheral groove 21 also exceeds the desired radius. The peripheral groove 21 is symmetrically disposed about a central plane that is perpendicular to the longitudinal axis of the mandrel portion 11.

The mandrel portion is provided a capacitor receiving cavity 29 which opens to, merges with, and is centered on the peripheral groove 21. The capacitor receiving cavity 29 is generally "U"-shaped and of length sufficient to accommodate the capacitor 31 of the tuned circuit assembly 15 and has a depth beyond the bottom of the peripheral groove 21 that exceeds the transverse dimension of the capacitor 31.

The cover band 13 is a molded part made of thermoplastic material in the general shape of a thin flat ring or band. The cover band 13 has an exterior surface 33 which is a segment of a circular cone, and inner peripheral surface 35, side edge surfaces 37 and undercut surfaces 39, 41. The mandrel portion outer peripheral surfaces 17, 19 are segments of a circular cone and the cover band inner peripheral surface 35 is a segment of the same circular cone so that the cover band inner peripheral surface 35 is matingly received by the mandrel portion outer peripheral surfaces 17, 19 when the parts are assembled. The mandrel portion and cover band respective undercut surfaces 23, 25, 39, 41 are adjacent respective side edge surfaces 43, 37, with respective pairs of the undercut surfaces 23, 39 and 25, 41 being spaced and juxtaposed when the mandrel portion 11 and cover band 13 are assembled and prior to being sealed (see FIGS. 8 and 12).

The mandrel portion 11 is provided a central web 45 having a plurality of side openings 47 therein and a center opening 49. The outer extremities of the central web merge with the central exterior surface 51 of the peripheral groove 21. The central opening 49 is circular.

One of the features of the invention is that the tuned circuit assembly is manufactured in place on the mandrel portion 11. To manufacture a tuned circuit assembly, the capacitor 31 is placed in the capacitor receiving cavity 29 and then the requisite turns of the coil 27 are wound onto the mandrel portion 11 and the coil 27 is then connected in parallel with the capacitor 31. In actual practice, a group of mandrel portions 11 (for example, eight) are disposed side by side on a spindel (not shown) that receives the web center openings 49, and coils 27 are wound simultaneously on all of them. The respective coil-capacitor connections are then made and are simultaneously dip soldered. This stage of the manufacture is schematically represented by FIG. 9. Then the respective peripheral grooves 21 and capacitor receiving cavities 29 are simultaneously filled (as the group assembly is slowly rotated) by a melted filling compound 53 which serves as a water block. This stage of the manufacture is schematically represented by FIG. 10. A cover band 13 is next assembled onto each mandrel portion 11, as schematically represented by FIG. 11. The electronic marker device, now ready for the sealing operation, is placed in a die press 55, as schematically represented by FIG. 12.

The die press 55 has a fixed bed 57 and a moveable head 59. The fixed bed 57 and the moveable head 59 are provided oppositely disposed circular dies 61, 63 having a "V"-shaped cross section. The fixed bed 57 has a cylindrical locator boss 65 which receives the web center opening 49 so that the electronic marker device is properly located relative to the circular dies 61, 63. The diameters of the circular dies 61, 63 are made such that the respective juxtaposed undercut surfaces 23, 39, 25, 41 are substantially centered on the apex of the respective "V" of the circular dies 61, 63. The circular dies 61, 63 are heated by conventional means (not shown). The magnitude of pressure applied by the moveable head 59 and the duration of such pressure are controllable by conventional means (not shown). In the sealing process, the thermoplastic material at the outer end portions of the respective juxtaposed undercut surfaces 23, 39, 25, 41 is melted as the sealing progresses, permitting the moveable head 59 to move downwardly and remolding the portions of the mandrel portion 11 and the cover band 13 in the regions of the undercut surfaces 23, 39, 25, 41 to form peripheral hermetic seals 67, 69 that have generally "V"-shaped exterior contours (see FIGS. 1–4). The peripheral groove 21 is provided a small venting port 71 (see FIG. 12) so that the excess air volume resulting from the sealing operation will be expelled and will not adversely affect the sealing action. The venting port 71 is closed (see FIG. 3) after the sealing operation is completed.

The steps in carrying out the method of making the electronic marker device of the invention may be stated as comprising the following:

a. producing a mandrel portion of thermoplastic material having a hoop shape with the thickness of the hoop in the radial direction being substantially less than the width of the hoop in the axial direction and having outer peripheral surfaces and side edge surfaces;

i. said mandrel portion being provided a peripheral groove and a capacitor receiving cavity;

b. providing a suitable capacitor for the tuned circuit and disposing it in said capacitor receiving cavity;

c. providing a length of insulated conductor suitable for the tuned circuit coil and winding the requisite number of turns of said conductor onto the groove of said mandrel portion to make up the tuned circuit coil;

d. connecting said capacitor in parallel with said coil;

e. providing a cover band of thermoplastic material having an inner peripheral surface sized and shaped so as to be matingly receivable by the said mandrel portion outer peripheral surfaces;

f. installing said cover band onto said mandrel portion;

g. hermetically sealing the side edge portions of said mandrel portion and said cover band.

The method steps recited above may be modified such that the sealing step is accomplished by placing the assembly of said mandrel portion, tuned circuit and cover band in a die press of suitable configuration and applying heat and pressure to said side edge surfaces to produce peripheral seals, thereby to isolate the interior of said mandrel portion and cover band assembly containing said tuned circuit from the exterior of said assembly.

The method steps recited above may be further modified to provide that said mandrel portion and said cover band are provided respective undercut surfaces adjacent said respective side edge surfaces, with respective pairs of said undercut surfaces being spaced and juxtaposed when said mandrel portion and said cover band are assembled and prior to being sealed, and the surfaces of said die press which contact said side edge surfaces are generally "V"-shaped so that the resulting peripheral seals have generally "V"-shaped exterior contours.

Typical dimensions and specifications regarding the electronic marker device of the invention may be stated as follows: For a tuned circuit assembly having a resonant frequency of 101.6 kilohertz, the capacitor 31 may be 22 thousand picofarads and the coil 27 may have 15 turns of 24 gauge copper wire having a 10 mil high density polyethylene jacket. The filling compound 53 may be 85 percent petrolatum and 15 percent polyethylene. The taper of the mandrel portion outer peripheral surfaces 17, 19 and the cover band inner peripheral surface 35 may be 3 degrees. The width of the mandrel portion 11 and cover band 13 in the axial direction prior to sealing may be 1½ inches. The thickness of the cover band 13 in the radial direction over the area of the inner peripheral surface 35 may be 90 thousandths inches. The thickness of the cover band 13 in the radial direction over the area of the undercut surfaces 39, 41 may be 45 thousandths inches. The thickness of the mandrel portion 11 in the radial direction over the areas of the outer peripheral surfaces 17, 19 may be 90 thousandths inches, and the thickness in the radial direction over the area of the undercut surfaces 23, 25 may be 45 thousandths inches. The widths of the undercut surfaces 23, 25, 39, 41 may be ¼ inches; the widths of the outer peripheral surfaces 17, 19 may be 11/32 inches; the width of the peripheral groove 21 may be 5/16 inches. The thickness of the central web 45 may be 60 thousandths inches. The diameter of the assembled electronic marker device prior to sealing may be 8 inches. A side of the "V" of the peripheral seals 67, 69 may be about ¼ inch and the included angle may be approximately 90 degrees. The temperature of the circular dies 61, 63 may be 450 degrees F., with a moveable head pressure of 30 psi applied to a 5 inch diameter piston for a period of 30 seconds. The thermoplastic material of which the mandrel portion and cover band are made may be a suitable polyolefin such as a suitable high density polyethylene.

It will be understood by those skilled in the art that the foregoing dimensions and specifications are by way of illustrative example only and may be changed in various ways without departing from the principles of the invention.

The improved electronic marker devices of the present invention are not subject to the disadvantages of the prior art electronic marker devices hereinbefore discussed. Electronic marker devices constructed in accordance with the principles of the present invention have excellent dimensional stability. The completed mandrel portion and cover band assembly are easily capable of withstanding the various forces normally encountered in their use environment without physical distortion. The structure of the completed mandrel portion and cover band assembly actually presents a greatly reduced exterior profile for the normally encountered forces to act upon. The coil of the tuned circuit assembly is provided excellent protection against physical distortion since it is closely contained within a substantially rigid housing. The resulting reliable improved performance for the tuned circuit makes possible smaller physical dimensions for all of the electronic marker device components, with resulting economies.

I claim:

1. An electronic marker device of the tuned circuit passive type comprising:

a. a mandrel portion of thermoplastic material having a hoop shape with the thickness of the hoop in the radial direction being substantially less than the width of the hoop in the axial direction and having outer peripheral surfaces and side edge surfaces;

b. a cover band of thermoplastic material having an inner peripheral surface that is matingly received by said mandrel portion outer peripheral surfaces, and having side edge surfaces, with said cover band being hermetically sealingly engaged with said mandrel portion in the region of corresponding side edge surfaces;

c. a tuned circuit assembly disposed within said mandrel portion.

2. The device of claim 1 wherein:

a. said mandrel portion is provided a peripheral groove and a capacitor receiving cavity;

b. said tuned circuit comprises a coil that is disposed within said peripheral groove and a capacitor that is disposed within said cavity.

3. The device of claim 2 wherein:

a. said capacitor receiving cavity has a depth beyond the bottom of said peripheral groove that exceeds the transverse dimension of said capacitor.

4. The device of claim 3 wherein:

a. said mandrel portion and said cover band are provided respective undercut surfaces adjacent said respective side edge surfaces, with respective pairs of said undercut surfaces being spaced and juxtaposed when said mandrel portion and said cover band are assembled and prior to being sealed.

5. The device of claim 4 wherein:

a. said undercut portions have been subjected to heat and pressure in a die press to form respective peripheral hermetic seals.

6. The device of claim 5 wherein:

a. said seals have generally "V" shaped exterior contours.

7. The device of any one of claims 1–6 wherein:

a. said peripheral groove is "U"-shaped.

8. The device of any one of claims 1–6 wherein said mandrel portion is provided a central web.

9. The device of any one of claims 1–6 wherein said mandrel portion is provided a central web having a plurality of side openings therein and a center opening.

10. The method of making an electronic marker device of the tuned circuit passive type comprising the steps of:

a. producing a mandrel portion of thermoplastic material having a hoop shape with the thickness of the hoop in the radial direction being substantially less than the width of the hoop in the axial direction and having outer peripheral surfaces and side edge surfaces;

i. said mandrel portion being provided a peripheral groove and a capacitor receiving cavity;

b. providing a suitable capacitor for the tuned circuit and disposing it in said capacitor receiving cavity;

c. providing a length of insulated conductor suitable for the tuned circuit coil and winding the requisite number of turns of said conductor onto the groove of said mandrel portion to make up the tuned circuit coil;

d. connecting said capacitor in parallel with said coil;

e. providing a cover band of thermoplastic material having an inner peripheral surface sized and shaped so as to be matingly receivable by the said mandrel portion outer peripheral surfaces;

f. installing said cover band onto said mandrel portion;

g. hermetically sealing the side edge portions of said mandrel portion and said cover band.

11. The method of claim 10 wherein:

a. said sealing step is accomplished by placing the assembly of said mandrel portion, tuned circuit and cover band in a die press of suitable configuration and applying heat and pressure to said side edge surfaces to produce peripheral hermetic seals, thereby to isolate the interior of said mandrel portion and cover band assembly containing said tuned circuit from the exterior of said assembly.

12. The method of claim 11 wherein:

a. said mandrel portion and said cover band are provided respective undercut surfaces adjacent said respective side edge surfaces, with respective pairs of said undercut surfaces being spaced and juxtaposed when said mandrel portion and said cover band are assembled and prior to being sealed, and the surfaces of said die press which contact said side edge surfaces are generally "V"-shaped so that the resulting peripheral hermetic seals have generally "V"-shaped exterior contours.

* * * * *